US012716258B2

(12) United States Patent
Chen et al.

(10) Patent No.: US 12,716,258 B2
(45) Date of Patent: Aug. 25, 2026

(54) ANTI-SEISMIC COMPONENT AND BUFFER WITH DUAL FUNCTIONS OF ENERGY CONSUMPTION AND BEARING CAPACITY

(71) Applicants: HUNAN UNIVERSITY, Changsha (CN); CHINA CONSTRUCTION FIFTH ENG. BUREAU CO., LTD., Changsha (CN)

(72) Inventors: Zhengqing Chen, Changsha (CN); Xugang Huang, Changsha (CN); Ou Yang, Changsha (CN); Shuai Zhou, Changsha (CN); Shuisheng Li, Changsha (CN)

(73) Assignees: HUNAN UNIVERSITY, Hunan (CN); CHINA CONSTRUCTION FIFTH ENG. BUREAU CO., LTD., Hunan (CN)

( * ) Notice: Subject to any disclaimer, the term of this patent is extended or adjusted under 35 U.S.C. 154(b) by 135 days.

(21) Appl. No.: 18/727,801

(22) PCT Filed: May 16, 2022

(86) PCT No.: PCT/CN2022/093023
§ 371 (c)(1),
(2) Date: Jul. 10, 2024

(87) PCT Pub. No.: WO2023/137929
PCT Pub. Date: Jul. 27, 2023

(65) Prior Publication Data

US 2025/0109604 A1 Apr. 3, 2025

(30) Foreign Application Priority Data

Jan. 18, 2022 (CN) ..... 202210055863.3

(51) Int. Cl.
*E04H 9/02* (2006.01)

(52) U.S. Cl.
CPC ..... *E04H 9/0237* (2020.05)

(58) Field of Classification Search
CPC . E04B 1/98; E04B 2001/2496; E04H 9/0237; E04H 9/0235; E04H 9/021
See application file for complete search history.

(56) References Cited

U.S. PATENT DOCUMENTS 6,438,905 B2 * 8/2002 Constantinou ..... E04H 9/0235 52/167.3
6,782,668 B2 * 8/2004 Bruce ..... G09F 19/22 52/127.2

(Continued)

FOREIGN PATENT DOCUMENTS

CN 101812879 A 8/2010
CN 102535671 A 7/2012

(Continued)

OTHER PUBLICATIONS

International Search Report, International Appl. No. PCT/CN2022/093023, dated Oct. 19, 2022; China National Intellectual Property Administration, Beijing, China.

(Continued)

*Primary Examiner* — Brian E Glessner
*Assistant Examiner* — Daniel J Kenny
(74) *Attorney, Agent, or Firm* — Central California IP Group, P.C.; Andrew D. Fortney

(57) ABSTRACT

Disclosed in the present invention are an anti-seismic component with dual functions of energy consumption and load bearing, and a buffer. The anti-seismic component includes a core shaft, wherein the core shaft is connected to a first support member and a second support member; an overhanging section of the first support member and an overhanging section of the second support member are respectively arranged on two sides of the core shaft; and an included angle between the first support member and the (Continued)

second support member is less than 180°. The component can be directly used as an inclined brace component of a building frame structure, and uses a circular tube torsional energy consumption mode to replace an axial tension and compression energy consumption mode of a traditional BRB component, thereby eliminating the problem of compressive buckling of a support component and simplifying the structure of a steel structure energy-consumption inclined brace; and there is no need for an external restrain component, thereby reducing steel consumption, avoiding filling with mortar, effectively shortening an installation period, improving the reliability of the component, and greatly reducing the manufacturing cost of the component. Therefore, the component has wide application prospects.

12 Claims, 4 Drawing Sheets

(56) References Cited

U.S. PATENT DOCUMENTS 8,763,320 B1 * 7/2014 Chou ..... E04H 12/16 52/167.3
10,106,979 B2 * 10/2018 Lee ..... E04B 1/98
10,167,652 B2 * 1/2019 Nakakubo ..... F16F 15/067
2012/0260585 A1 * 10/2012 Mualla ..... E04B 1/98 52/167.1
2020/0392752 A1 12/2020 Dicleli

FOREIGN PATENT DOCUMENTS

| | | | |
|---|---|---|---|
| CN | 103603426 | * | 11/2013 |
| CN | 105507132 | A | 4/2016 |
| CN | 105672523 | A | 6/2016 |
| CN | 108505640 | A | 9/2018 |
| CN | 111962707 | A | 11/2020 |
| JP | H0754894 | B2 * | 6/1995 |
| JP | 2013129982 | A | 12/2014 |

OTHER PUBLICATIONS

Written Opinion, International Appl. No. PCT/CN2022/093023, dated Oct. 13, 2022; China National Intellectual Property Administration, Beijing, China.

* cited by examiner

ANTI-SEISMIC COMPONENT AND BUFFER WITH DUAL FUNCTIONS OF ENERGY CONSUMPTION AND BEARING CAPACITY

CROSS REFERENCE TO RELATED APPLICATION(S)

This application is a national phase application of International Appl. No. PCT/CN2022/093023, filed May 16, 2022, and claims the benefit of Chinese Patent Application No. 202210055863.3, filed Jan. 18, 2022.

TECHNICAL FIELD

The invention relates to the technical field of structural seismic reduction and isolation, in particular to an anti-seismic component and a buffer with dual functions of energy consumption and bearing.

BACKGROUND

At present, BRB (Buckling Restraint Brace) is the most widely used component in the seismic design of steel structures, which generally uses plastic metal material with low yield strength as the inner core and is composed of restrained components (usually steel pipes filled with mortar) and unbonded materials or gaps between them. Among them, the plastic metal inner core is connected with the main structure, which provides lateral support when the structure bears earthquake action, and uses the plastic deformation of the inner core to dissipate energy; The main function of the restraint parts is to restrain the buckling instability of the metal core under compression, ensure that the metal core can achieve full-section yield under compression, and enhance the energy consumption capacity of the core; Unbonded materials are used to eliminate the axial force transmission between the metal core and the constraint parts. However, the structure of this kind of members is complex, especially when the mortar is filled in the steel pipe, the construction quality is difficult to guarantee, and the above structural measures to prevent the buckling of the inner core also lead to the high steel consumption and cost of BRB members.

SUMMARY OF THE INVENTION

The purpose of the present invention is to overcome the shortcomings of the existing buckling-restrained brace members, such as complicated structure, large steel consumption, and difficult guarantee of construction quality when internal mortar is filled, and to provide an earthquake-resistant member and a buffer with dual functions of energy dissipation and bearing.

In order to achieve the above objectives, the present invention provides the following technical scheme:

An earthquake-resistant member with dual functions of energy dissipation and bearing comprises a mandrel, wherein a first support and a second support are connected to the mandrel; the cantilever sections of the first support and the second support are respectively arranged at two sides of the mandrel; and the included angle between the first support and the second support is less than 180°.

The included angle is an initial included angle, and preferably, the included angle is 90°-160°.

By adopting the seismic component with dual functions of energy dissipation and bearing, the core component adopts the mandrel as the energy dissipation component, The first support and the second support which are oppositely arranged can be respectively used for connecting the corresponding positions of the main structure, which is consistent with the existing rotary connection mode between the BRB member and the main structure. Forming an oblique supporting structure along the diagonal of the frame, wherein the cantilever section of the first support and the cantilever section of the second support are oppositely arranged on both sides of the mandrel, and the included angle between the first support and the second support is less than 180°, so that the anti-seismic member forms a broken-line structure. When the cantilever end of the first support (the end far from the mandrel) and the cantilever end of the second support (the end far from the mandrel) are subjected to external loads, the relative position between the cantilever end of the first support and the cantilever end of the second support will change, the included angle between the first support and the second support is changed, so that the mandrel can be twisted and deformed, thereby generating torque, which in turn can cause the support rod to generate bending moment and axial force, thus resisting the external load and making the component have bearing capacity.

The parameters of each component are determined according to the design requirements. By adjusting the stiffness of the first support and the second support, the structural size of the mandrel and the initial included angle, the mandrel can enter the full-section plastic state after the external load exceeds a certain critical value, and the in-plane torsional shear stress is equal everywhere, while the first support and the second support are in the elastic range. The plastic energy dissipation performance of metal materials is fully utilized to achieve the effect of consuming seismic energy, so the component has the ability of energy dissipation and earthquake resistance, thus having dual functions of energy dissipation and bearing. This member breaks through the energy consumption mode of traditional BRB members in axial tension and compression, eliminates the problem of compression buckling of supporting members, simplifies the structure of energy-consuming diagonal braces of steel structures, reduces the steel consumption and avoids filling mortar, effectively shortens the installation period, improves the reliability of members, greatly reduces the manufacturing cost of members, and has a wide application prospect.

Preferably, the mandrel is a tube structure.

Further preferably, the mandrel is a circular tube, and the ratio of the outer diameter to the wall thickness of the circular tube is less than 8.

Further reduce the steel consumption, at the same time, ensure the effective energy consumption through the thick wall and avoid the local buckling of the mandrel, ensure the reliability of the component, and reduce the steel consumption of each component.

Preferably, the first support and the second support are both hollow rods.

Compared with solid members, it is beneficial to further reduce the steel consumption. The cross-section can be circular or rectangular, and its size and wall thickness are determined according to the length and bearing capacity requirements.

It is further preferred that the first support and the second support are members with the same shape and size.

Preferably, the first support is connected with the mandrel through a first connecting sleeve sleeved in the middle of the mandrel, and the second support is connected with the mandrel through two second connecting sleeves sleeved at the corresponding ends of the mandrel, and the first support and the second support are oppositely arranged.

Preferably, the first support can be fixedly sleeved at one end of the mandrel through a first connecting sleeve, and the second support can be fixedly sleeved at the other end of the mandrel through a second connecting sleeve. The first support and the second support are respectively located at two ends of the mandrel and are arranged in a staggered manner.

Preferably, the mandrels can be replaced by two, and the first support and the second support are respectively connected to the corresponding mandrels, and the two mandrels are connected through connectors.

The mandrel is fixedly connected with the connecting piece, and the first support and the second support respectively drive the corresponding mandrel to undergo torsional deformation.

Further preferably, both the cantilever end of the first support and the cantilever end of the second support have mounting holes.

It can be installed by connecting the bolt through the mounting hole, which effectively improves the installation efficiency. The mounting hole can also be used for mounting the mandrel.

A bumper comprises two oppositely arranged the anti-seismic members with dual functions of energy consumption and bearing, and the cantilever ends of two first supports are connected by connecting pieces. The cantilever ends of two second supports are connected by connecting pieces, and the cantilever ends of the first support and the second support are both rotatably connected with the corresponding connecting plates.

With the adoption of the buffer provided by the invention, when the relative positions of two opposite connecting pieces change, the mandrel can be twisted and deformed to consume energy, thus effectively realizing buffering. At present, the landing protection of rockets and airdropped heavy objects, or in order to protect the ground and structures from being damaged by heavy objects falling at high speed, all need long-stroke and high-energy-consuming buffers. At present, such buffers generally use foamed aluminum as energy-consuming materials, However, it can only be used once, and it is difficult to establish an accurate calculation model, so the buffer calculation mode of the application is clear; By increasing the length of the support, the stroke and energy consumption can be increased; In general, only the mandrel is twisted, other parts will not be damaged, and the metal mandrel with good ductility can be forcibly restored to deformation, so it can be used for many times.

Preferably, the openings of the two anti-seismic members are oppositely arranged, which is conducive to further reducing the steel consumption.

Further preferably, both the cantilever end of the first support and the cantilever end of the second support can be replaced by being fixedly connected to the connecting piece through a mandrel.

That is, both ends adopt mandrels, which effectively enhance the energy consumption capacity.

To sum up, compared with the prior art, the invention has the following beneficial effects:

1. By adopting the anti-seismic component with dual functions of energy dissipation and bearing, the relative position between the cantilever end of the first support and the cantilever end of the second support will change, The included angle between the first support and the second support is changed, so that the mandrel can be twisted and deformed, thereby generating torque, which in turn can cause the support rod to generate bending moment and axial force, thus resisting the external load and making the component have bearing capacity; Under the action of external force, the cross section of the mandrel will enter a plastic yield state, so as to achieve the effect of consuming seismic energy, so the component has the ability of energy dissipation and earthquake resistance, thus having dual functions of energy dissipation and bearing.

2. In this component, the torsional energy consumption mode replaces the axial tension and compression energy consumption mode of the traditional BRB component, which eliminates the problem of compression buckling of the support component, simplifies the structure of the energy-consuming diagonal brace of the steel structure, reduces the steel consumption, avoids filling mortar, effectively shortens the installation period, improves the reliability of the component, and greatly reduces the manufacturing cost of the component.

3. The steel consumption is low and the mandrel will not buckle locally, so the reliability of the component is high.

4. By adopting the buffer provided by the invention, the design calculation mode is clear; By increasing the length of the support, the stroke and energy consumption can be increased; In general, only the mandrel is twisted, other parts will not be damaged, and the metal mandrel with good ductility can be forcibly restored to deformation, so it can be used for many times.

Drawing reference signs: 1—Mandrel, 21—A first support, 22—The second mounting plate, 31—The first connecting sleeve, 32—The second connecting sleeve, 4—Mounting hole, 5—Connectors.

EMBODIMENTS

The present invention will be further described in detail with reference to the attached drawings and specific embodiments. However, it should not be understood that the scope of the above-mentioned subject matter of the present invention is limited to the following embodiments, and all technologies realized based on the contents of the present invention belong to the scope of the present invention.

Embodiment 1

Figure 1:
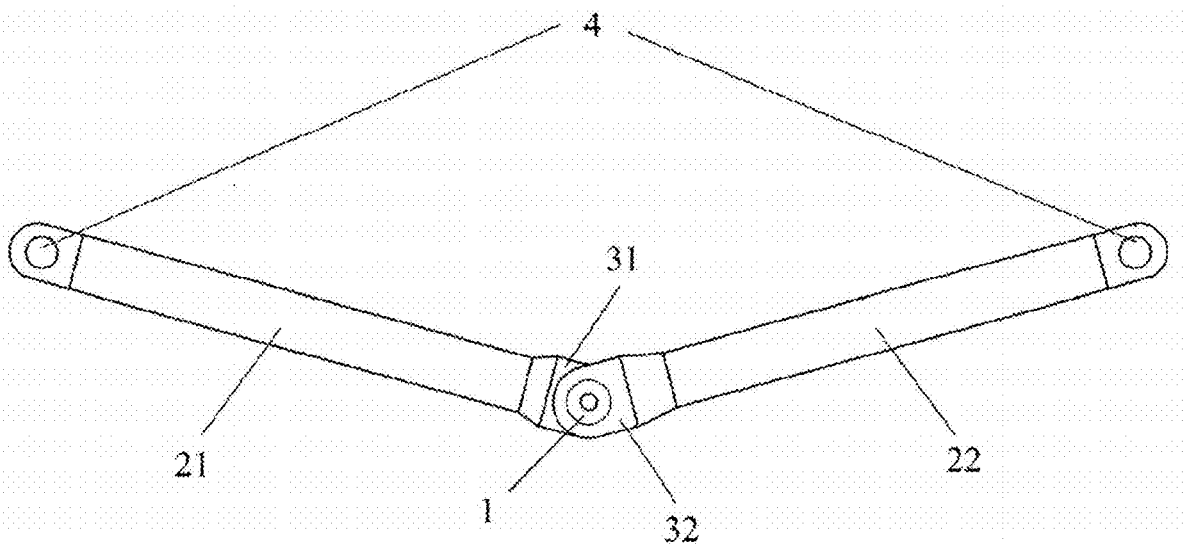
FIG. 1 is the structural schematic diagram of an anti-seismic member with dual functions of energy dissipation and bearing in Embodiment 1.
Figure 2:
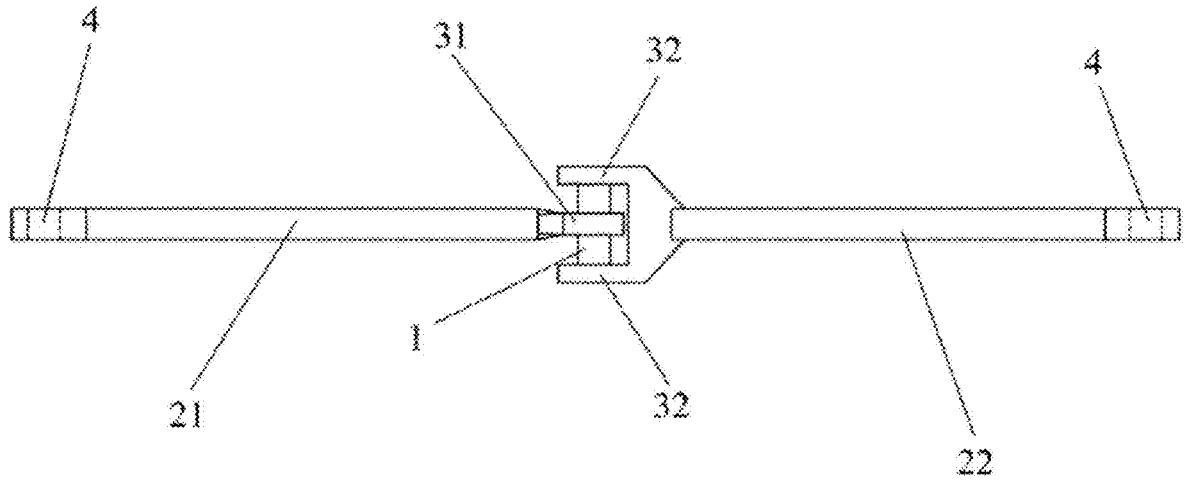
FIG. 2 is a top view of the structure of FIG. 1.

An earthquake-resistant member with dual functions of energy dissipation and load bearing, as shown in FIG. 1-2, comprises a mandrel 1, The mandrel 1 is connected with a first support 21 and a second support 22, The cantilever section of the first support 21 and the cantilever section of the second support 22 are respectively arranged on both sides of the mandrel 1, The first support 21 and the second support 22 should be arranged relatively, that is, in the same plane as far as possible, so as to ensure that the mandrel 1 only undergoes torsional deformation. The included angle between the first support 21 and the second support 22 is less than 180°, forming a broken-line structure as shown in FIG. 1, The included angle between the first support member 21 and the second support member 22 is designed according to energy consumption requirements, application scenarios and the like, More than one first support 21 and second support 22 can be arranged on the mandrel 1.

Specifically, the material and structural parameters of the mandrel 1 are determined according to the deformation and energy consumption requirements of components, such as steel components, The mandrel 1 can be a solid member or a hollow member. Preferably, the mandrel 1 is a hollow tube structure with a circular cross section, and its wall thickness and diameter are determined according to the requirements of energy consumption and load bearing, The ratio of the outer diameter to the wall thickness of the circular tube is less than 8, which further reduces the steel consumption, and at the same time, avoids the local buckling of the mandrel 1 and ensures the reliability of the component, of course, other cross-sectional forms can be adopted in some scenes. The included angle between the first support 21 and the second support 22 is the initial installation included angle. For example, it can be designed according to the allowable elastic displacement angle and plastic displacement angle between frames given in the seismic design, so that the axial force in the first support 21 and the second support 22 is in a reasonable state. When the allowable displacement angle of elastic deformation is exceeded, the mandrel 1 will enter the plastic yield energy consumption area in time, and within the allowable displacement angle of plastic deformation, the mandrel 1 will produce as large torsional strain as possible to achieve the best energy consumption effect.

Preferably, the first support 21 and the second support 22 are hollow bars with good structural support and low steel consumption, and the cross-sectional form can be circular, rectangular or I-shaped. For convenience of design, the first support 21 and the second support 22 should be equal-section members with the same shape and size. The first support 21 and the second support 22 can be connected to the mandrel 1 by welding. In this embodiment, The first support 21 is fixedly sleeved in the middle of the mandrel 1 through a first connecting sleeve 31, The second support 22 is fixedly sleeved on the mandrel 1 through two second connecting sleeves 32, The two second connecting sleeves 32 are symmetrically arranged on both sides of the first connecting sleeve 31, The first support 21 and the second support 22 are located in the central part of the mandrel 1 and coplanar, so as to further ensure the stability of the components, preferably, the two second connecting sleeves 32 are located at the corresponding ends of the mandrel 1, so as to further reduce the steel consumption, as shown in FIG. 2. The joint between the first connecting sleeve 31 and the first supporting member 21, and the joint between the second connecting sleeve 32 and the second supporting member 22 all bear a certain bending moment, which can be solved by enhancing the local stiffness.

Figure 3:
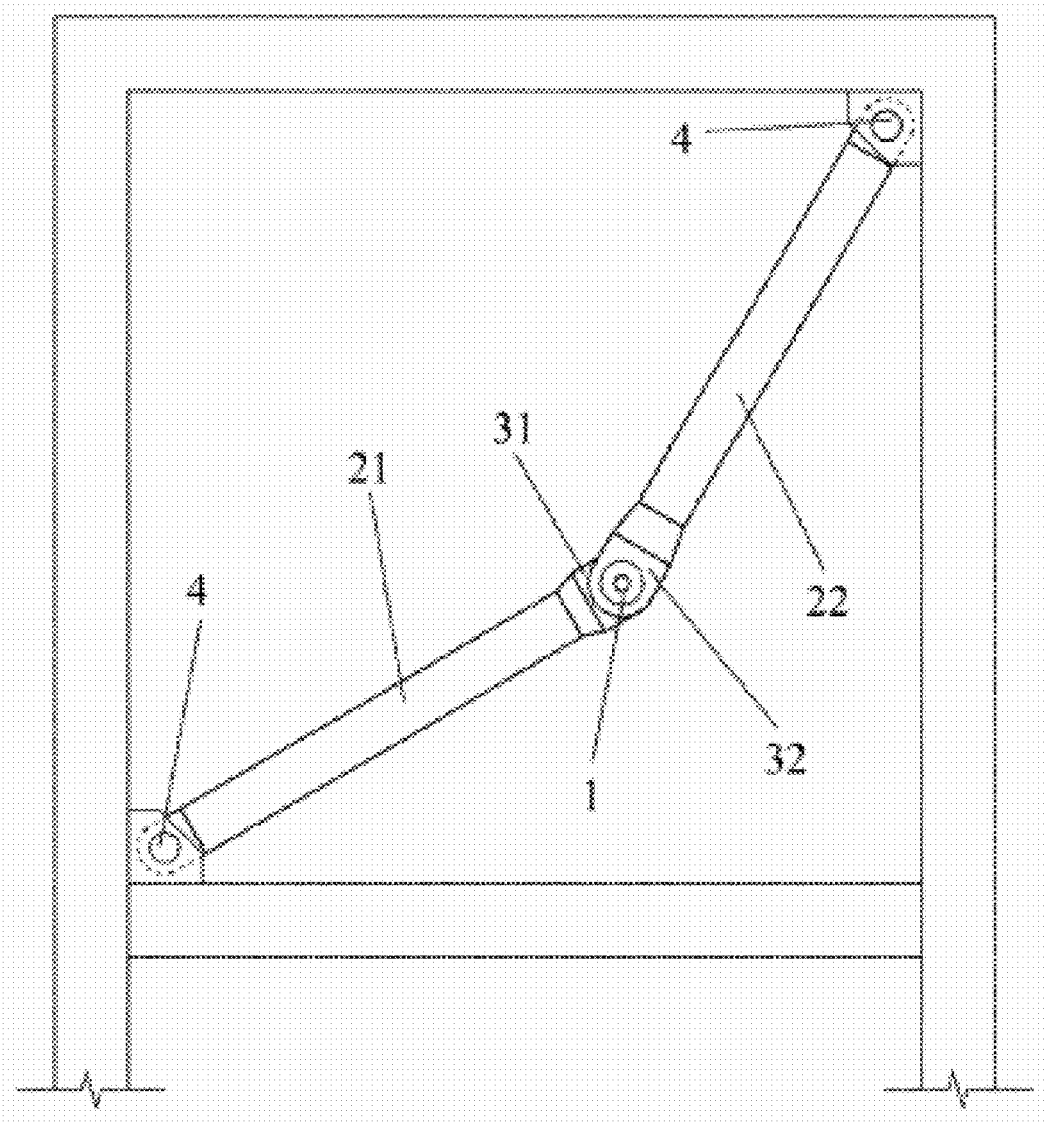
FIG. 3 is a schematic diagram of the use of an anti-seismic component with dual functions of energy dissipation and bearing in Embodiment 1.

When in use, the rotating connection mode with the main structure is consistent with the existing linear BRB component, forming an oblique diagonal installation. This embodiment takes a frame structure building as an example, as shown in FIG. 3. The first support 21 is rotatably connected to the left side of the lower frame, The second support 22 is rotatably connected to the right side of the upper frame, The connection positions of the first support 21 and the second support 22 can also be interchanged from left to right, and the upper and lower floors can be interchanged, but the two ends of the core member (energy dissipation member) are no longer directly connected to the main structure. The included angle between the first support 21 and the second support 22 is preferably 140°-150°, which is beneficial to the oblique arrangement and installation of this component and the shear deformation under horizontal force. The distal ends of the first support 21 and the second support 22 can rotate. In order to facilitate installation, the distal ends of the first support 21 and the second support 22 are both provided with mounting holes 4. For example, by arranging a connecting plate, the mounting holes 4 are arranged on the connecting plate, and pins penetrate through the mounting holes 4 to connect with the connecting holes of the node plates on the frame structure, so that the installation efficiency is high.

When the lower end of the first support 21 and the upper end of the second support 22 are sheared and deformed due to horizontal load, the relative position between the two ends will change, so that the included angle between the first support 21 and the second support 22 will also change, and then the mandrel 1 can be twisted and deformed, thus generating torque, which in turn will make the support rod generate bending moment and axial force, thus resisting the external load and making the component have bearing capacity; Under the action of horizontal earthquake force, the section of mandrel 1 will enter a plastic yield state, which makes full use of the plastic energy dissipation performance of metal materials to achieve the effect of consuming earthquake energy. Therefore, this component has the ability of energy dissipation and earthquake resistance, thus having dual functions of energy dissipation and bearing. This member breaks through the energy consumption mode of traditional BRB members in axial tension and compression, and adopts the torsion energy-consuming supporting structure, which eliminates the problem of buckling of supporting members under pressure, simplifies the structure of energy-consuming diagonal braces of steel structure, reduces the steel consumption without external constraint members, avoids filling mortar, effectively shortens the installation period, improves the reliability of members, and greatly reduces the manufacturing cost of members, and has a wide application prospect.

Figure 4:
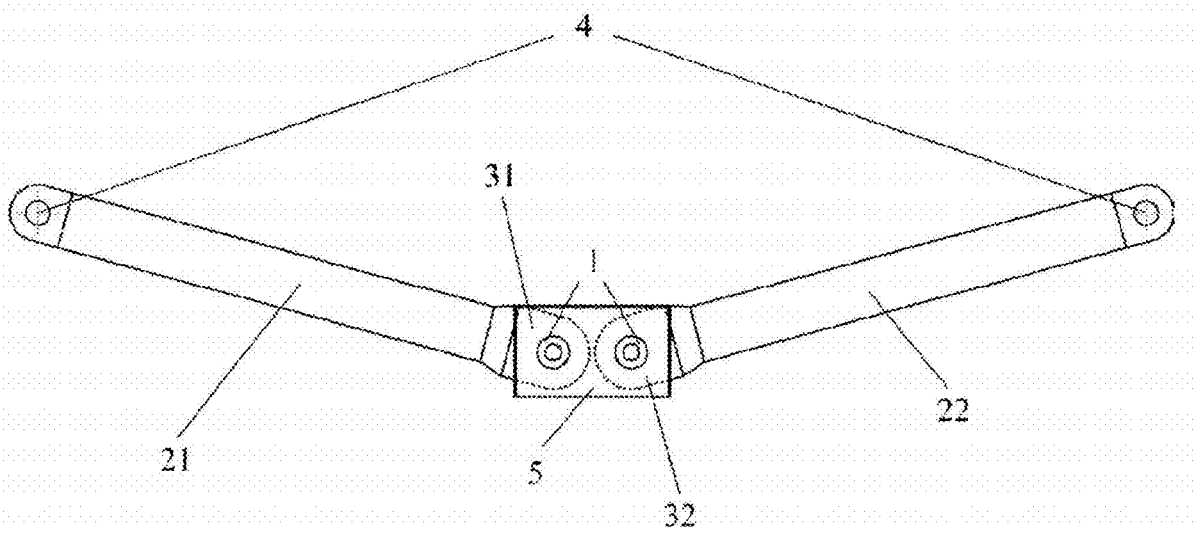
FIG. 4 is the structural schematic diagram of an anti-seismic member with dual functions of energy dissipation and bearing in Embodiment 2.

Taking Q235 steel as an example, the tensile yield strength of mandrel 1 is about 305 MPa, and the torsional yield strength is about 220 MPa. If the existing linear BRB members are adopted, the yield energy dissipation section is 1650 mm in length, with an area of 419 mm2, the transition section (the part between the extension section and the yield section of the core member) is 1120 mm in length, the buckling-restrained sleeve is 200*100*10 mm, and the overall steel consumption is about 180 kg. The yield load (supporting force) is 127.8 kN, assuming that the elongation of linear BRB members is 2%, the work done once is about 7.05 kJ. If the anti-seismic member of this application is adopted, the inner diameter of the mandrel 1 is 40 mm, the outer diameter is 80 mm, the length is 160 mm, the initial opening angle is 150°, and the center distance of the mounting hole 4 in FIG. 4 is 2770 mm, then the overall steel consumption is about 140 kg, which obviously reduces the steel consumption, the yield torque is 51.6 KN*m, and the corresponding maximum supporting force is 209.44 kN; Assuming that the elongation of the connection end is 2%, the work done once is about 8.92 kJ. In summary, the performance of the seismic member of the present invention is better than that of the existing BRB member.

In addition, only one second connecting sleeve 32 can be connected to the second support 22, and the first connecting sleeve 31 and the second connecting sleeve 32 can also be respectively sleeved at both ends of the mandrel 1, so that the first support 21 and the second support 22 are arranged in a staggered manner.

Embodiment 2

Figure 5:
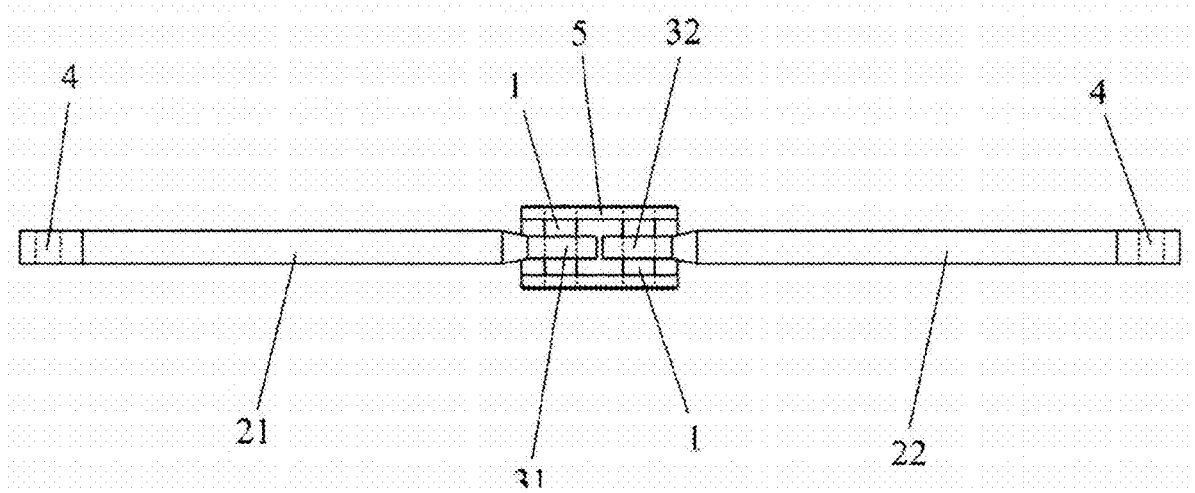
FIG. 5 is a top view of the structure of FIG. 4.

An earthquake-resistant member with dual functions of energy dissipation and bearing is basically the same as that of Embodiment 1, but the difference is that, The mandrels 1 can be replaced by two, the first support 21 and the second support 22 are respectively connected to the corresponding mandrels 1, and the two mandrels 1 are connected through the connector 5, as shown in FIG. 4-5. The first support 21 and the second support 22 are still symmetrically arranged, the first connecting sleeve 31 and the second connecting sleeve 32 may have the same structure as the first connecting sleeve 31 in Embodiment 1, and they are both sleeved in the middle of the corresponding mandrels 1. The connector 5 may be a trough-shaped structural member, and both mandrels 1 are fixedly connected with two side plates of the trough-shaped structural member, and the first support 21 and the second support 22 respectively drive the corresponding mandrels 1 to undergo torsional deformation.

Embodiment 3

A buffer comprises two anti-seismic members with dual functions of energy dissipation and bearing as described in Embodiment 1 or 2, which are oppositely arranged, the cantilever ends of the two first supports 21 are connected by the connecting piece 5, and the cantilever ends of the two second supports 22 are connected by the connecting piece 5, or the cantilever ends of the first supports 21 and the second supports 22 of another seismic member are connected through the connector 5, The cantilever end of the first support member 21 and the cantilever end of the second support member 22 are both rotatably connected with the corresponding connecting plate 5, for example, they are both connected with the connecting plate 5 through a pin shaft through a mounting hole 4. The two seismic members should adopt the same structure, such as the structure in which the first support 21 and the second support 22 in Embodiment 1 are sleeved on the same mandrel 1 or the structure in which the first support 21 and the second support 22 in Embodiment 2 are sleeved on one mandrel 1 respectively.

Figure 6:
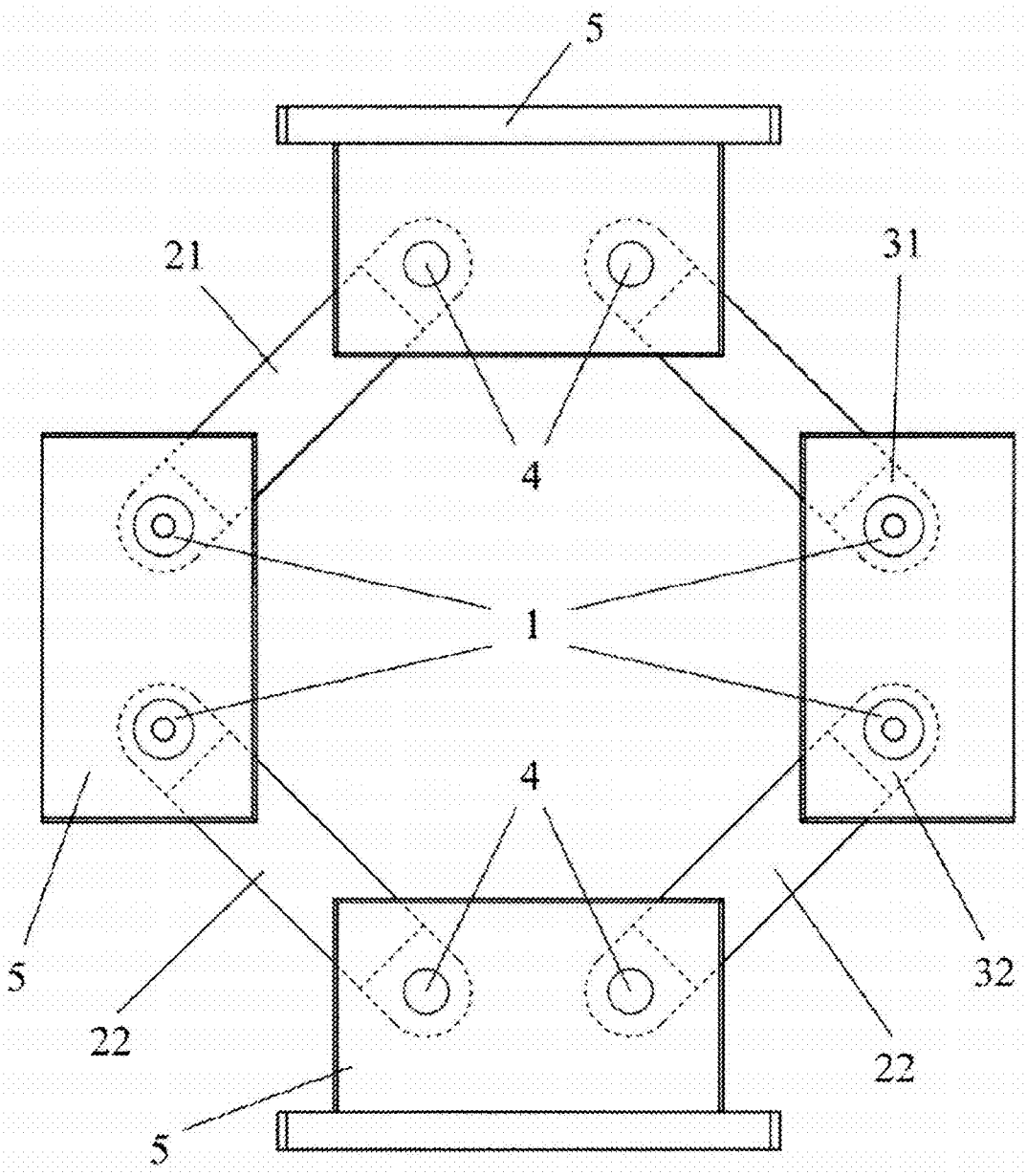
FIG. 6 is the structural schematic diagram of a buffer in Embodiment 3.

As shown in FIG. 6, the left and right sides are respectively provided with an anti-seismic member as described in Embodiment 2, and the openings of the two anti-seismic members are opposite to each other or can be set back, and the two anti-seismic members are connected through a connector 5. The connecting pieces 5 can adopt the same groove structure as in Embodiment 2. In specific use, the two connecting pieces 5 (left and right in FIG. 6) inside the seismic member can be used for relative position change, or the connecting pieces 5 (upper and lower in FIG. 6) used for connecting two seismic members can be used for relative position change. If it is used for vertical buffering on the ground, in FIG. 6, the lower connector 5 is fixedly connected to the ground, and the upper connector 5 is used to bear external impact. Correspondingly, the bottom plates of these two connectors 5 should be widened, as shown in FIG. 6.

In addition, both the cantilever end of the first support 21 and the cantilever end of the second support 22 can be fixedly connected to the connector 5 through the mandrel 1, that is, the position of the mounting hole 4 in the FIG. can be connected with the corresponding connector 5 by the mandrel 1, which is beneficial to enhancing the energy consumption capacity.

The above is only the preferred embodiment of the invention, and it is not used to limit the invention. Any modification, equivalent substitution and improvement made within the spirit and principle of the invention should be included in the protection scope of the invention.

What is claimed is:

1. A bumper, comprising two oppositely arranged anti-seismic members with dual functions of energy consumption and bearing, wherein each anti-seismic member comprises first and second mandrels, a first support (21) connected to the first mandrel, a second support (22) connected to the second mandrel, and a connector (5) connecting the first and second mandrels, the first support (21) includes a first cantilever section and the second support (22) includes a second cantilever section, the first cantilever section and the second cantilever section are on opposite sides of the first and second mandrels, the first support (21) and the second support (22) have an included angle therebetween that is less than 180°, the first support (21) of each anti-seismic member has a first cantilever end connected to the first cantilever end of the other anti-seismic member through a first connecting piece, the second support (22) of each anti-seismic member has a second cantilever end connected to the second cantilever end of the other anti-seismic member through a second connecting piece, the first cantilever ends of the first supports (21) and the second cantilever ends of the second supports (22) are rotatably connected with the corresponding first and second connecting pieces, and when relative positions of the first and second connecting pieces change, the first and second mandrels twist and deform to consume energy.

2. The bumper according to claim 1, wherein each of the first and second mandrels comprises a tube structure.

3. The bumper according to claim 2, wherein each of the first and second mandrels comprises a circular tube, and a ratio of an outer diameter to a wall thickness of the circular tube is less than 8.

4. The bumper according to claim 1, wherein each of the first support (21) and the second support (22) comprise a hollow bar.

5. The bumper according to claim 1, wherein the first support (21) is connected with the first mandrel through a first connecting sleeve (31) fixedly sleeved on the first mandrel and the second support (22) is connected with the second mandrel through a second connecting sleeve (32) fixedly sleeved on the second mandrel.

6. The bumper according to claim 1, wherein each of the first cantilever end of the first support (21) and the second cantilever end of the second support (22) have a mounting hole (4).

7. The bumper according to claim 1, wherein the connector comprises a trough-shaped structural member having two side plates, and the first and second mandrels are fixedly connected with the two side plates of the trough-shaped structural member.

8. The bumper according to claim 7, wherein the first support and the second support are in a same plane and respectively drive the corresponding first and second mandrels to undergo torsional deformation.

9. The bumper according to claim 1, wherein each of the first and second mandrels comprises a metal with a ductility sufficient for the mandrel to be forcibly restored.

10. The bumper according to claim 9, wherein the metal is Q235 steel.

11. The bumper according to claim 1, wherein when the first and second mandrels are twisted and deformed, the first and second mandrels generate torque, which in turn makes the first and second supports generate a bending moment and axial force, thus resisting an external load and making the bumper have bearing capacity.

12. The bumper according to claim 9, wherein, under a horizontal earthquake force, a section of each of the first and second mandrels enters a plastic yield state, which makes use of a plastic energy dissipation performance of the metal to consume earthquake energy, and provide the bumper with an energy dissipation ability and earthquake resistance.

* * * * *